US005507074A

United States Patent [19]

Chen et al.

[11] Patent Number: 5,507,074

[45] Date of Patent: Apr. 16, 1996

[54] DECORTICATING METHOD FOR SEPARATING BAST FROM CORE OF FORAGE CHOPPED KENAF OR THE LIKE

[75] Inventors: Lung-hua Chen, Rancho Palos Verdes, Calif.; Jonathan Pote; Marty Fuller, both of Starkville, Miss.

[73] Assignee: Mississippi State University, Mississippi State, Miss.

[21] Appl. No.: 393,824

[22] Filed: Feb. 24, 1995

[51] Int. Cl.[6] ..... D01B 1/40

[52] U.S. Cl. ..... 19/5 R; 19/5 A; 209/2; 209/3; 209/10

[58] Field of Search ..... 19/5 R, 5 A, 10, 19/11, 19, 21, 22, 23, 24, 25, 26, 29, 30, 31, 32, 33, 66 R; 241/24, 79; 209/2, 3, 10, 333

[56] References Cited

U.S. PATENT DOCUMENTS

| | | | |
|---|---|---|---|
| 494,174 | 3/1893 | Smith | 19/5 A |
| 494,175 | 3/1893 | Smith | 19/5 A |
| 1,447,449 | 3/1923 | Wessel | 19/24 |
| 2,690,596 | 10/1954 | Angiolini et al. | 19/24 |
| 5,316,150 | 5/1994 | Fisher | 209/30 |
| 5,447,238 | 9/1995 | Aldridge et al. | 209/3 |

*Primary Examiner*—Michael A. Neas

*Attorney, Agent, or Firm*—Oblon, Spivak, McClelland, Maier & Neustadt

[57] ABSTRACT

A method of decorticating short lengths, typically three to five inches of material such as kenaf to separate bast from core and which has been harvested by a chopper harvester of the type used for harvesting stripped corn stalks. Material is subjected to abrading by a saw blade roller and travels down a screen for treatment by a combing action which results in separation of substantially all core from bast. The core passes through the screen and the bast is swept over the end of the screen onto respective collection conveyors.

4 Claims, 1 Drawing Sheet

DECORTICATING METHOD FOR SEPARATING BAST FROM CORE OF FORAGE CHOPPED KENAF OR THE LIKE

FIELD OF THE INVENTION

The present invention relates to a method of decorticating the outer bark or bast from the inner core of material such as kenaf, or jute and more particularly to a method of decorticating forage chopped material of this nature and which will hereafter be referred to as kenaf though the invention is not necessarily restricted to use with kenaf.

BACKGROUND OF THE INVENTION

In a copending application 08/261,978 filed Jun. 17, 1994 and assigned to the same assignee as the present invention a decorticating machine and method are described for decorticating lengths of kenaf which may be up to 12 feet. It has been discovered that harvesting kenaf by conventional forage chopping harvesters such as used for harvesting stripped corn stalks is especially convenient. Conventional harvesting methods, however, result in bulk kenaf in chopped lengths of two to five inches. This comprises both bast and core. Separating the bast from the core where the pieces of kenaf are typically about three to five inches in length presents special problems which cannot be handled by the machinery designed to handle stalks up to 12 feet in length. Hence the broad object of the present invention is to provide a method of separating bast from core wherein the kenaf has been forage harvested into chopped lengths of typically about three to five inches.

SUMMARY OF THE INVENTION

In the process of harvesting kenaf by forage chopping about 95% of the core becomes separated from the bast although still mixed. To separate this mixture, the lengths of bast and core, separated or not, are conveyed to a pair of crusher rollers that crush the unseparated lengths and feed the mixture onto a downwardly sloping, vibrating screen having a mesh small enough to pass the core but not the bast. In the preferred embodiment the crush rollers propel the crushed mixture against a rearwardly sloping deflector shield from which it falls onto the screen. Separated core and bast as well as unseparated core and bast are fed to a saw blade roller which is spaced above the surface of the screen in a position to engage the unseparated bast and core while not engaging the separated core. No harm is done if small amounts of the core are engaged by the saw blade roller. The majority of the core falls through the screen but should core, though separated from the bast, remain enmeshed with the bast, a series of counter moving combs engage the bast and core mixture and further separates any remaining core allowing it to fall through the screen. Conveyors beneath the screen and at the lower end of the screen convey the separated core and bast to their places of use.

BRIEF DESCRIPTION OF THE DRAWING

The single FIGURE is a schematic perspective view illustrating the method of the invention.

DETAILED DESCRIPTION OF THE INVENTION

Figure 1:
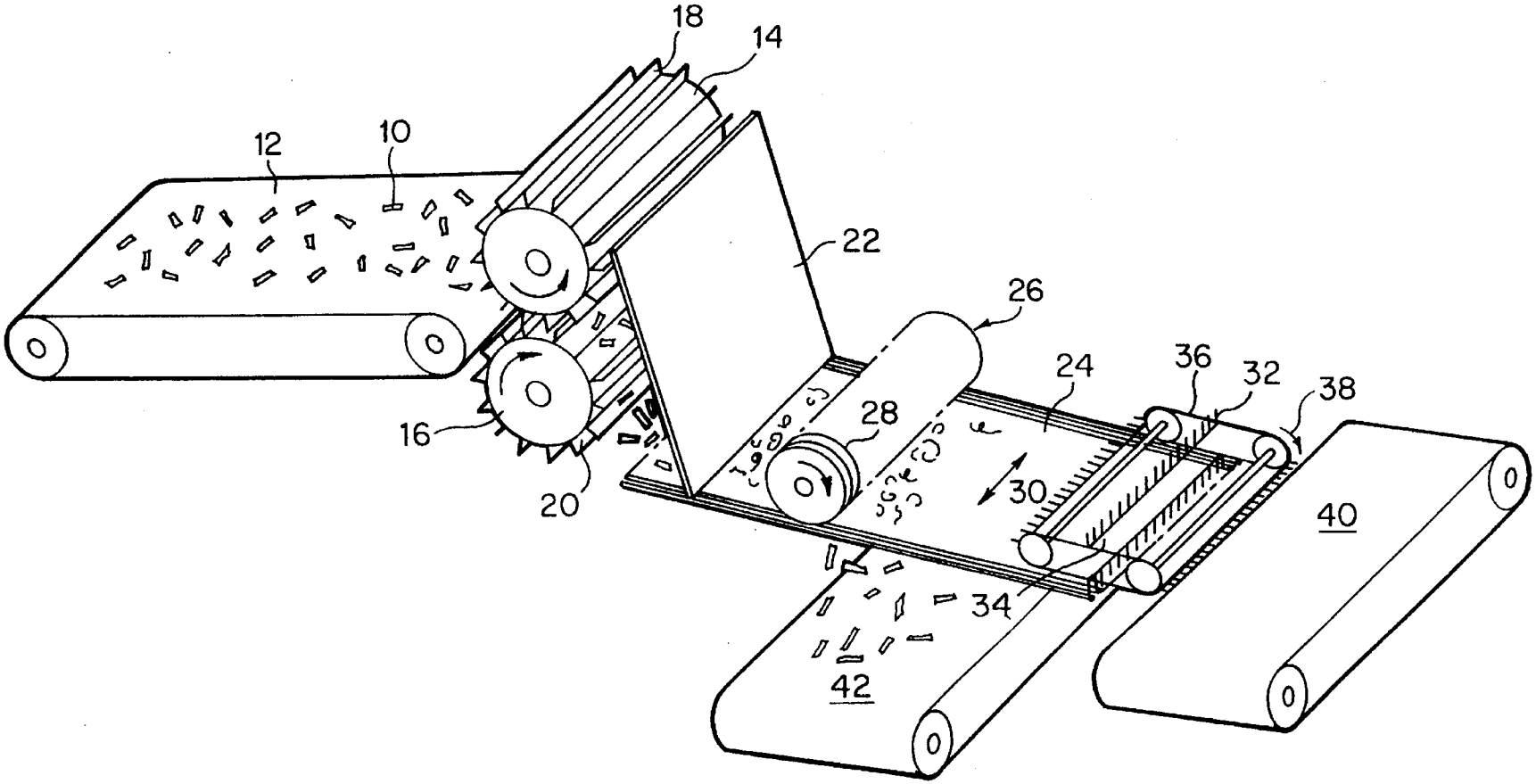

As explained above, the invention is concerned with the method of separating the bast from the core of kenaf stalk sections of typically about three to five inches in length resulting from forage chopping of kenaf stalks by known corn stalk forage choppers. As mentioned, this type of harvesting automatically separates about 95% of the bast from the core, but leaves them mixed. This invention separates the remainder of bast and core as well as segregating the mixed bast and core previously separated by the forage harvesting process.

Referring now to the single figure, lengths (10) of bast and core separated during harvesting or unseparated bast and core are placed on a conveyor (12) which feeds the lengths to the bight between first and second rollers (14, 16) having intermeshing blades (18, 20) which further crush and split the bast relative to the core. The bast and core, separated or not, are propelled by the rollers (14, 16) against rearwardly sloping deflector shield (22) which guides and evenly distributes the bast and core onto the upper end of a downwardly sloping vibrating screen (24) having a mesh of a size to accept the core but restrict the passage of bast. As the mixture moves down the screen by gravity it passes beneath a blade roller (28) which is positioned above the surface of the screen a distance not less than the thickness of the bast and core though somewhat less than the thickness of the core, the distance is not critical since the blade roller encourages the passage of loose core material through the screen.

The blade roller is driven clockwise relative to the screen and is comprised of side-by-side circular saw blades having fine teeth of the size for cutting plywood. The blades are desirably mounted about 1½' apart on an axle and serve to abrade any bast not already separated from the core to further complete the decorticating operation. However, the bast is stringy and some core material is necessarily entrapped in the bast. We have discovered that the core material can be readily combed out of the bast by the use of a series of combs (30) comprised of laterally spaced spikes (32) supported at right angles on cross bars (34) extending across the screen (24) with their opposite ends fixed to endless conveyor belts (36). The combs are driven in the direction of the arrow (38) counter to the direction of travel of the bast and core material down the slope of the screen (24). As the spikes engage the bast-core mixture additional core is combed or shaken from the bast to fall through the screen. The bast will be picked-up by the comb teeth and this also frees core from bast until finally most of the bast is deposited on a conveyor (40) at the end of the screen. The core material drops onto a conveyor (42) whereby it is moved to its place of use.

The method of the invention should be apparent from what has been described above.

What is now claimed is:

1. A method for decortication of forage chopped material to separate the outer bast fibers from the inner core thereof typically about three to five inches in length, comprising the steps of feeding said lengths to a bight of first and second bladed feed rollers for feeding said lengths in a downstream direction, the respective blades of said rollers intermeshing to crush and split the bast fiber about said core, feeding said crushed and split lengths from said feed rollers onto a downwardly sloped vibrating screen having upper and lower ends, passing the crushed and split lengths beneath a saw toothed roller in close adjacency to the upper end of the surface of the screen to abrade unseparated lengths into core and bast, said screen having a mesh of a size to pass through core but substantially no bast, continuing to vibrate said screen as the remainder of bast and core travels downward by gravity, and finally subjecting said bast and core still remaining on the screen to an opposing combing action to ensure that substantially all core passes through the screen, and then collecting separately the core material passing through the screen and the bast falling off the end of said screen.

2. The method of claim 1, wherein said saw toothed roller is spaced from the screen a distance less than the average thickness of the core.

3. The method of claim 1, wherein the step of feeding said crushed and split lengths from said feed rollers includes propelling said lengths against a rearwardly sloping deflector shield.

4. The method of claim 1, wherein the bast fiber is picked up by a series of combs while the core material falls through the screen.

* * * * *